US006358005B1

(12) United States Patent
Berfield

(10) Patent No.: US 6,358,005 B1
(45) Date of Patent: Mar. 19, 2002

(54) VANELESS IMPELLER HOUSING FOR A VACUUM CLEANER

(75) Inventor: Robert C. Berfield, Jersey Shore, PA (US)

(73) Assignee: Shop Vac Corporation, Williamsport, PA (US)

( * ) Notice: Subject to any disclaimer, the term of this patent is extended or adjusted under 35 U.S.C. 154(b) by 0 days.

(21) Appl. No.: 09/656,679

(22) Filed: Sep. 7, 2000

Related U.S. Application Data

(63) Continuation of application No. 09/248,487, filed on Feb. 10, 1999.

(51) Int. Cl.[7] ..... F04D 29/44

(52) U.S. Cl. ..... 415/206; 415/207; 415/211.2; 415/226

(58) Field of Search ..... 415/206, 207, 415/213.1, 214.1, 226, 211.2; 417/423.2, 424.1, 423.14; 15/327.1, 327.6

(56) References Cited

U.S. PATENT DOCUMENTS

| | | | | |
|---|---|---|---|---|
| 2,135,036 A | | 11/1938 | Karlstrom | 183/35 |
| 2,477,681 A | | 8/1949 | Anderson | 60/60 |
| 2,658,665 A | | 11/1953 | Tschudy | 230/117 |
| 2,982,986 A | | 5/1961 | Tupper | 15/327 |
| 3,263,909 A | | 8/1966 | Mazepa | 230/117 |
| 3,832,085 A | | 8/1974 | DeFauw et al. | 415/119 |
| 3,936,240 A | * | 2/1976 | Dochterman | 417/368 |
| 4,057,370 A | | 11/1977 | Numata et al. | 417/366 |
| 4,065,233 A | | 12/1977 | Torigoe et al. | 417/368 |
| 4,111,615 A | | 9/1978 | Watanabe | 417/423 |
| 4,280,245 A | | 7/1981 | Hiester | 15/326 |
| 4,330,899 A | | 5/1982 | Miller et al. | 15/326 |
| 4,435,877 A | | 3/1984 | Berfield | 15/326 |
| 4,512,713 A | | 4/1985 | Berfield | 415/119 |
| 4,527,960 A | * | 7/1985 | DeSisto | 417/368 |
| 4,797,072 A | | 1/1989 | Berfield et al. | 417/423.2 |
| 4,808,090 A | | 2/1989 | Evans | 417/423.2 |
| 4,836,753 A | * | 6/1989 | Berfield et al. | 417/236 |
| 5,400,463 A | | 3/1995 | Attard et al. | 15/326 |
| 5,647,091 A | * | 7/1997 | deBlois et al. | 15/323 |
| 5,737,797 A | | 4/1998 | Rittmueller et al. | 15/326 |
| 5,855,469 A | | 1/1999 | McConnell | 415/171.1 |
| 6,158,083 A | * | 12/2000 | Holsten | 15/326 |

OTHER PUBLICATIONS

International Search Report, International Application No. PCT/US99/14698, International Filing Date Jun. 30, 1999, Annex to the International Search Report.

* cited by examiner

*Primary Examiner*—Edward K. Look
*Assistant Examiner*—Ninh Nguyen
(74) *Attorney, Agent, or Firm*—Marshall, Gerstein & Borun

(57) ABSTRACT

A vacuum cleaner includes a driven impeller that moves working air for the vacuum cleaner. A first housing includes a first wall and a second housing includes a second wall opposite the first wall, and an outlet for the working air. The impeller rotates and draws the working air through an opening and directs the working air radially outwardly toward the first wall and then through an annular passage formed between the first wall and the second wall. The annular passage restricts the flow of working are to provide back pressure on the impeller.

16 Claims, 5 Drawing Sheets

VANELESS IMPELLER HOUSING FOR A VACUUM CLEANER

This is a Continuation of U.S. application Ser. No. 09/248,487, filed Feb. 10, 1999.

FIELD OF THE INVENTION

The present invention relates generally to vacuum cleaners and more particularly to a vaneless impeller housing for a vacuum cleaner that increases operating efficiency and reduces noise attributable to air flow.

BACKGROUND OF THE INVENTION

Efficient and quiet operation are important requirements for vacuum cleaners and similar air moving devices. To move the working fluid, i.e., air, within the vacuum cleaner an impeller is generally rotated within a housing by an electric motor. The impeller draws air at a central location and expels air about its circumference. The housing encloses the impeller and generally includes an air inlet passage located adjacent a central location on an inlet side of the impeller and a discharge passage extending about the circumference of the impeller.

It is known that some resistance to the free discharge of air from the impeller, or back pressure, increases its operating efficiency. Vanes are frequently provided disposed about the circumference of the impeller and within the discharge passage to provide back pressure. The vanes may have an involute configuration and are generally arranged to at least partially restrict the air flow. One disadvantage arising from the use of vanes in this manner is that they tend to generate noise. Air is a compressible fluid. As an impeller blade passes adjacent a leading edge of a vane the air is compressed and rapidly decompressed creating pressure pulses, i.e., noise. This noise is objectionable particularly in a vacuum cleaning device that may be used in a home or workshop.

Past proposals for eliminating or reducing noise include placing a dome structure over the housing into which the air is discharged. The large plenum created by the dome structure and the indirect pathway between the housing discharge passage and an air exit in the dome structure cooperate to reduce noise. Another proposal uses complex involute passages formed in the housing adjacent the circumference of the impeller. The involute passages are intended to provide smooth air flow and an increasing volume into which the discharge air decelerates to static pressure. These and other proposals, while offering varying degrees of success in maintaining impeller operating efficiency and reducing noise, have not been entirely satisfactory. Furthermore, a number of these proposals have added to the overall size of the impeller housing, and the complex involute passage proposal particularly adds to the manufacturing cost and complexity of the vacuum cleaner product.

SUMMARY OF THE INVENTION

In accordance with one aspect of the present invention, a vacuum cleaner includes a driven impeller that moves working air for the vacuum cleaner. A housing for the impeller has a first housing member including a first wall, a second housing member including a second wall opposite the first wall and an outlet for the working air. The impeller rotates and draws the working air through an opening and directs the working air radially outwardly toward the first wall and through a discharge passage formed between the first wall and the second wall. The discharge passage is annular and is substantially unobstructed. The discharge passage has a substantially constant width between the first wall and the second wall from its inlet to its outlet, which serves as a restriction on the working air to provide back pressure.

In accordance with a preferred form of the present invention, the working air is substantially unobstructed as it passes through the discharge passage, and the first and second housings are separate components. In addition, both the annular passage and the working air are unobstructed by vanes.

In accordance with another aspect of the present invention, a vacuum cleaner includes a driven impeller that moves the working air for the vacuum cleaner, a first housing including a first wall, a second housing including a second wall opposite the first wall, and wherein the first and second walls define an annular passage within an outlet passage for the working air. The impeller rotates and draws the working air through an opening and directs the working air radially outwardly toward the first wall and then through the annular passage. The annular passage is substantially uninterrupted about its full circumference. The annular passage may further define a minimum cross-section within the outlet.

In accordance with a further aspect of the present invention, a housing for an air impeller has a first housing and a second housing including a first wall and a second wall separated by a recess. The first housing and the first wall of the second housing define an annular passage for working air moved by the impeller. The annular passage is substantially uninterrupted about its full circumference.

In accordance with an even further aspect of the present invention, a vacuum cleaner includes a driven impeller that moves working air for the vacuum cleaner, a housing in which the impeller rotates, and an outlet for the working air. The housing has a first wall having an opening therein for admitting the working air, a second wall located generally radially outwardly from the impeller attached to the wall, a third wall attached to the second wall, a fourth wall opposite the first wall, and a fifth wall opposite the third wall and connected to the fourth wall. The fifth wall and the third wall form an annular passage that is substantially uninterrupted about a full circumference thereof.

Other features and advantages are inherent in the apparatus and methods claimed and disclosed or will become apparent to those skilled in the art from the following detailed description in conjunction with the accompanying drawings.

DETAILED DESCRIPTION OF THE PREFERRED EMBODIMENTS

Figure 1:
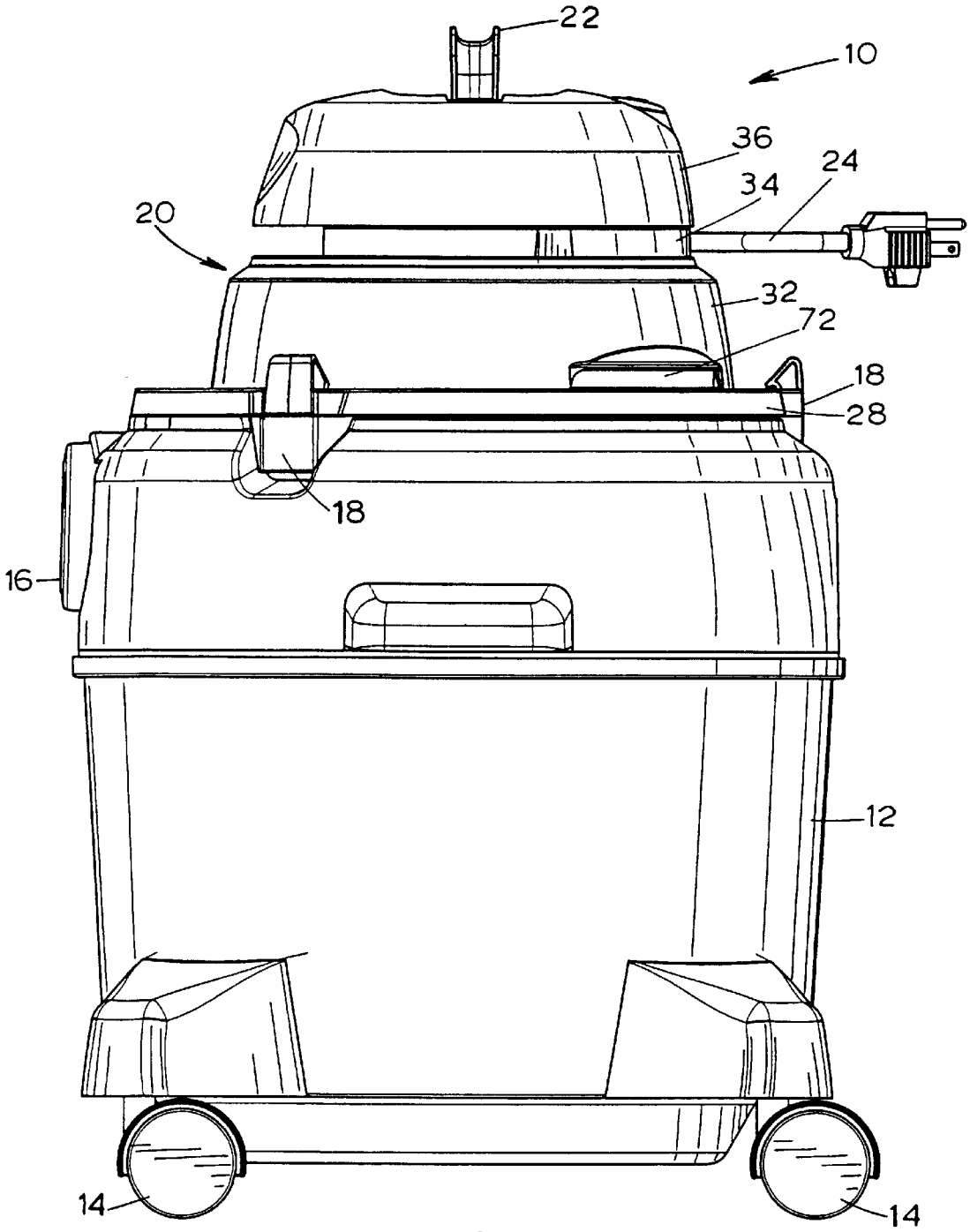
FIG. 1 is a front view of a vacuum cleaner provided with a vaneless impeller housing in accordance with preferred embodiments of the present invention.
Figure 2:
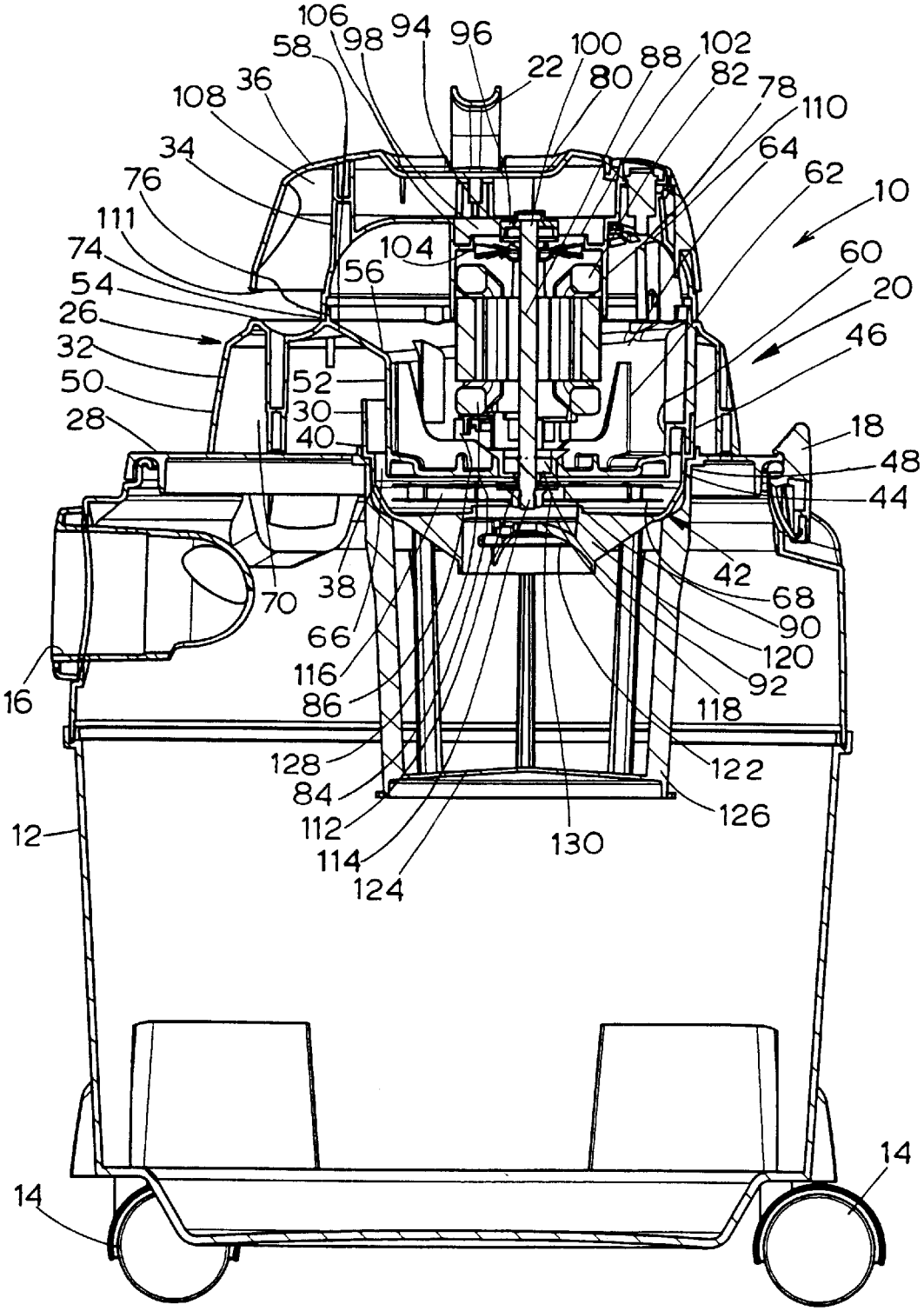
FIG. 2 is a cross-section view of the vacuum cleaner shown in FIG. 1.
Figure 3:
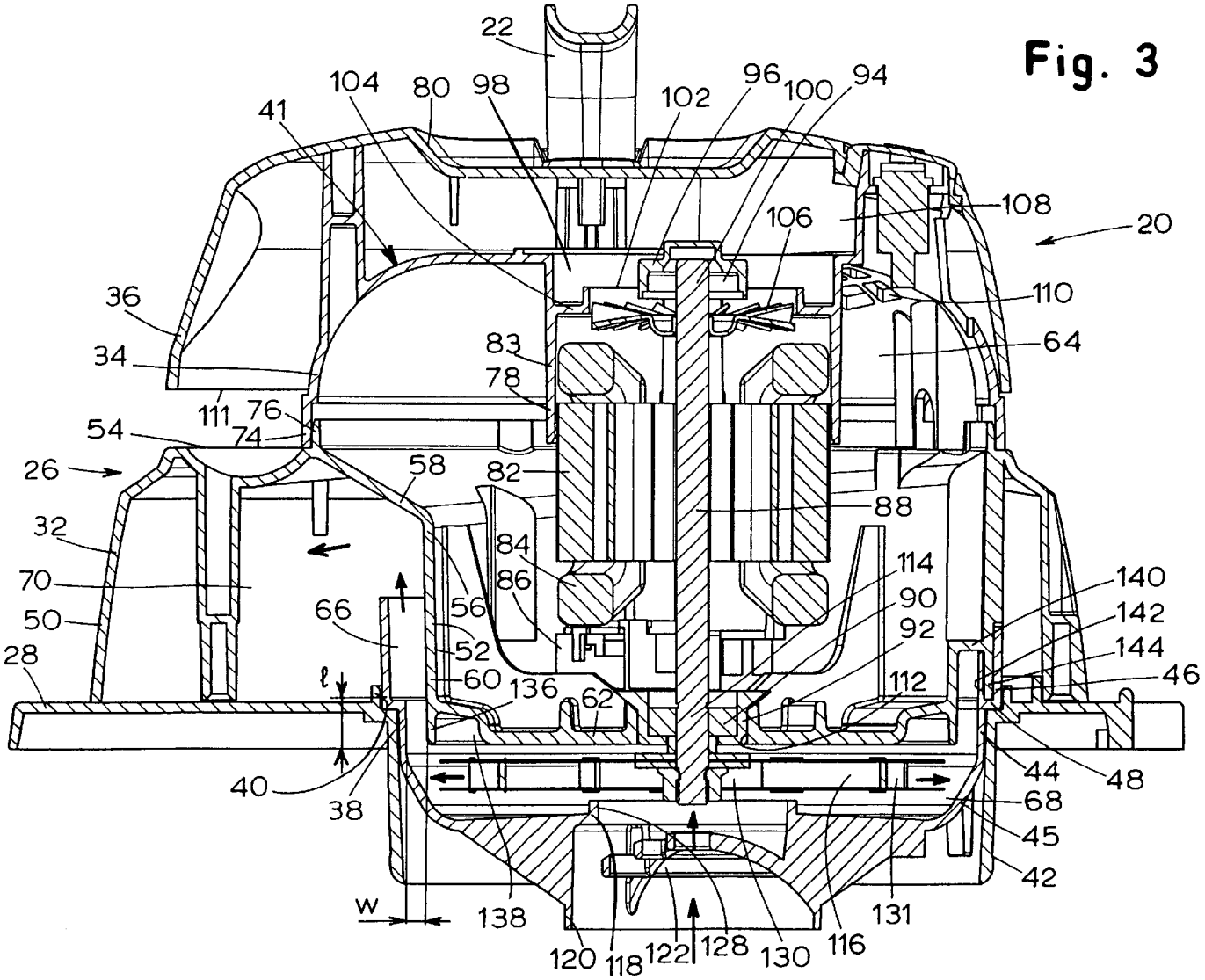
FIG. 3 is an enlarged partial cross-section of the vacuum cleaner shown in FIG. 1.

With reference now to FIGS. 1–3, a canister type vacuum cleaner 10 includes a debris collection cannister 12 supported upon casters 14. An aperture 16 is formed in a side of cannister 12 and is adapted to received a vacuum hose or similar attachment (not shown). Secured to an open top of cannister 12 by over-center type latches 18 is a vacuum assembly 20 including a handle 22 and a power cord 24.

Referring more particularly now to FIG. 2 and FIG. 3, vacuum assembly 20 includes a housing assembly 26 formed by the joining of a plurality of housing members, respectively, members 28, 30, 32, 34 and 36. Preferred housing members are formed from plastic materials, such as polypropylene, polyethylene, ABS and similar materials, and are joined using sonic welding, heat staking, adhesive bonding, threaded fasteners or combinations of these and other joining techniques as are well-known in the art. Member 28 forms a closure for the open top of cannister 12 and is retained thereto by latches 18. Member 28 includes formed offset from its center a flanged aperture 38 including a rabbet 40.

Member 30 forms an upper portion of an impeller housing 42. Member 30 includes a first cylindrical wall portion 44 separated from a second cylindrical wall portion 46 by a step offset 48. Wall portion 46 is received through aperture 38 with stepped offset 48 engaging rabbet 40, and member 30 is then secured to member 28.

Member 32 includes an substantially cylindrical outer wall 50 and a substantially cylindrical inner wall 52 the upper edges 54 and 56, respectively, of which are joined by a wall 58. A lower end 60 of inner wall 52 is enclosed by an end wall 62, forming a cavity 64 that makes up a lower portion of a motor housing 41. Opposite cavity 64, inner wall 52 and end wall 62 form an upper portion of impeller housing 42.

Inner wall 52 is separated from wall portion 44 defining an annular passage 66 between an impeller cavity 68 and a discharge plenum 70 formed between inner wall 52 and outer wall 50. Outer wall 50 includes a plurality of outlet passage 72 (best seen in FIG. 1) which permit the discharge of working air from discharge plenum 70 from the vacuum assembly 20.

Member 34 has a dome configuration and includes a cylindrical flange 74. Wall 58 is formed with an upwardly extending cylindrical flange 76, and member 34 is disposed over member 32 enclosing cavity 64. Flange 74 engages flange 76 for locating and securing member 34 to member 32. Member 34 further includes a cylindrical wall 78 that extends downwardly into cavity 64 from an upper portion of member 34. Member 36 also has a dome configuration and is secured over member 34, and handle 22 is formed on an outer upper surface 80 of member 36.

An electric motor 82 is disposed at its upper end 83 within cylindrical wall 78 and is supported axially at its lower end 84 on ribs 86. Motor 82 includes an axially extending motor shaft 88 which projects upwardly from upper end 83 and downwardly from lower end 86. In addition to the bearings supporting shaft 88 within motor 82, shaft 88 may also be journally supported by a bearing 90 retained within a bearing retainer 92 within ribs 86 and by a bearing 94 retained within a bearing retainer 96 retained within a cylindrical recess 98 formed in an upper portion of member 34. A fan 106 is secured to an upper end 100 of shaft 88 adjacent a vent aperture 102 also formed in the upper portion of member 34. Vent aperture 102 is defined by a radially inwardly extending flange 104, and fan 106 is retained on shaft 88 adjacent flange 104. During operation of motor 82, fan 106 draws air into cavity 64 via apertures 110 and upwardly from within cavity 64 and over motor 82. The air is expelled from vent aperture 102 into a cavity 108 formed between member 34 and member 36 and outwardly from cavity 36 through opening 111 formed between member 32 and member 36. Therefore, in a preferred embodiment of the present invention working air is not used for cooling motor 82.

A lower end 114 of shaft 88 extends downwardly through an aperture 112 formed in end wall 62 and into impeller housing 68. An impeller 116 is secured to lower end 114 within impeller housing 68 and adjacent a inlet passage 118 formed in member 30. Inlet passage 118 includes a downwardly extending cylindrical portion 120 within which are formed a plurality of louvers 122. Secured over inlet passage 118 opposite impeller housing 68 and within cannister 12 is a filter retainer 124 and a filter 126, each of which are of typical construction. Inlet passage 118 further includes an upwardly extending shroud portion 128 disposed adjacent a central portion 130 of impeller 116.

When motor 82 is operating, impeller is rotationally driven within impeller housing 68. As illustrated by the arrows in FIG. 3, working air is drawn from cannister 12, through filter 126, through inlet passage 118 to central portion 130 of impeller 116. Impeller 116 drives the working air radially outwardly toward wall 44. A lower portion 45 of wall 44 is angled to directed the working air toward and through annular passage 66. As can be seen from the drawings, annular passage 66 is formed substantially without obstruction about its entire circumference. In addition, annular passage 66 has a substantially constant width, "w" in FIG. 3, from an inlet 132 to an outlet 134. In this regard, annular passage 66 forms a minimum cross-section within the working air discharge path, i.e., the path from the outer circumference 131 of impeller 116, into plenum 70 and to outlets 72. This minimum cross-section creates back pressure for impeller 116 thereby increasing its efficiency. Moreover, because annular passage 66 is substantially obstruction free, noise normally associated with vanes or other obstructions in the discharge path for creating back pressure is substantially reduced or eliminated. It will be appreciated that for various applications the width of annular passage 66, and hence the size of the minimum cross-section, may be adjusted to provide the desired amount of back pressure for optimum impeller efficiency. As best seen in FIG. 3, wall member 60 extends as a cylindrical flange 136 adjacent a recess 138 formed in end wall 62. Lengthening or shortening cylindrical flange 136 correspondingly lengthens or shortens a length "1" of annular passage 66, respectively increasing or decreasing the amount of back pressure it creates. Similarly, cylindrical flange may be moved inwardly, towards recess 138, or outwardly to respectively increase or decrease the width of annular passage 66. This similarly increases or decreases the amount of back pressure provided by annular passage 66.

Figure 4:
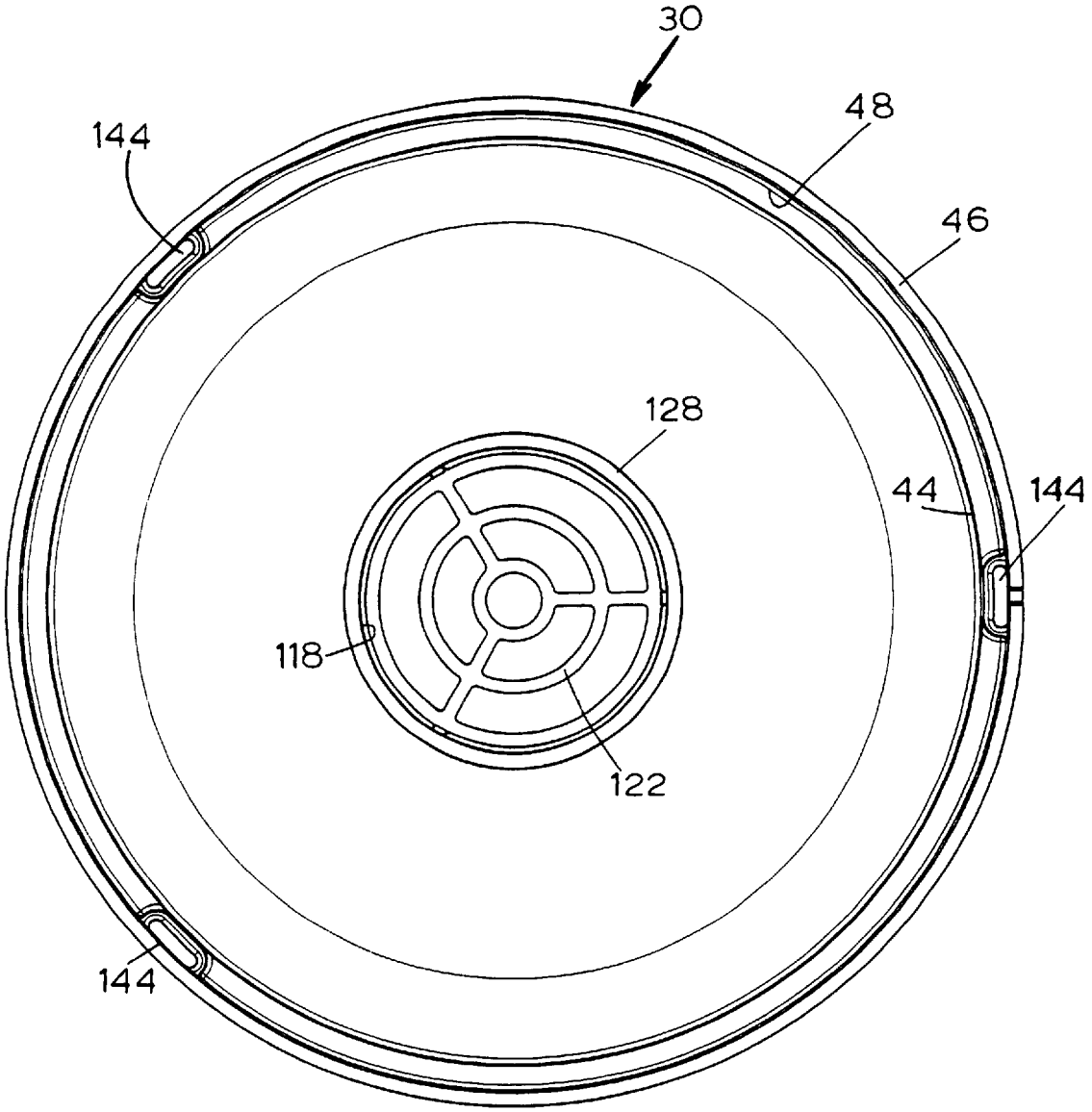
FIG. 4 is a top plan view of a first housing member for a vaneless impeller housing in accordance with the present invention.
Figure 5:
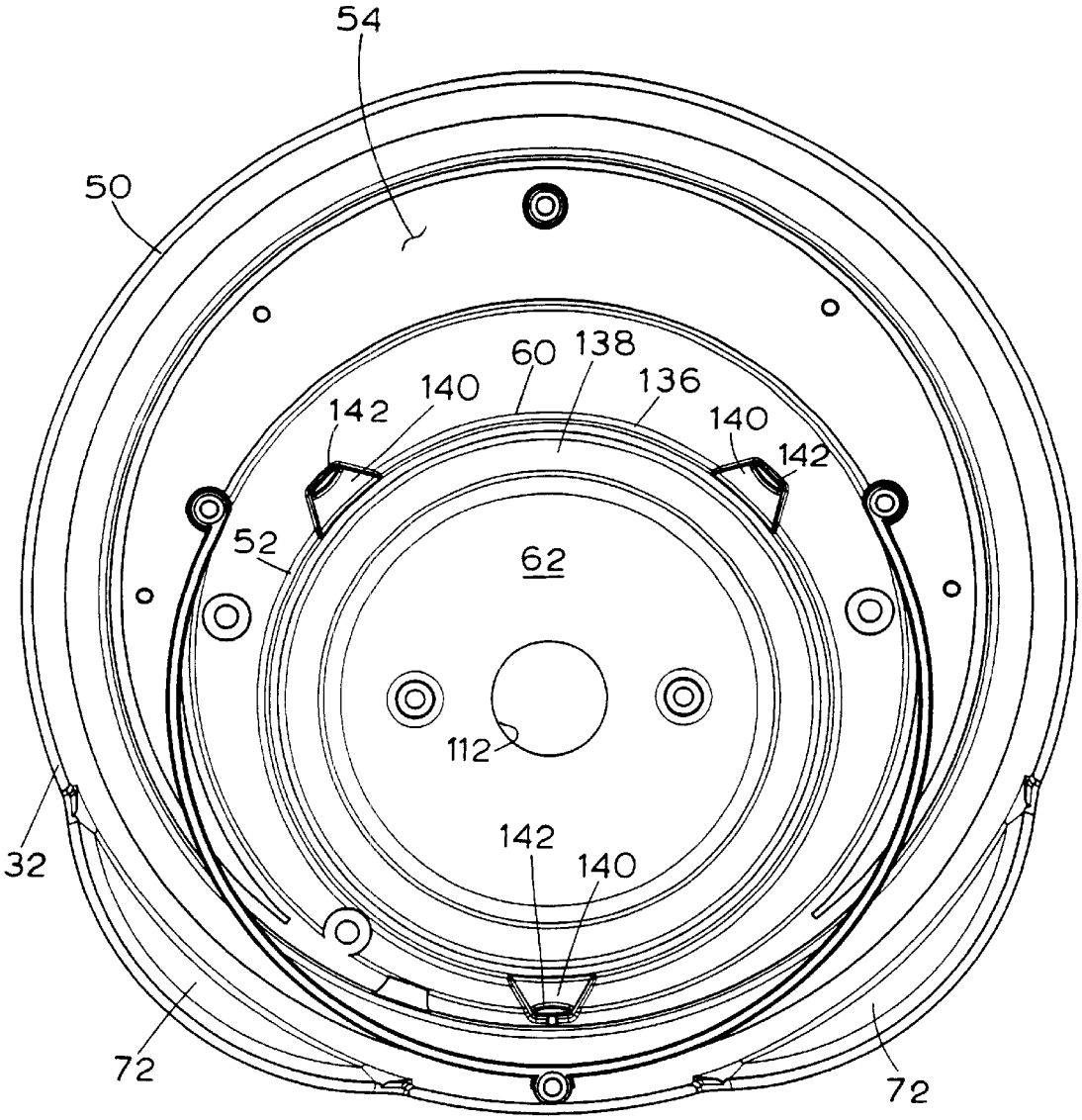
FIG. 5 is a bottom plan view of a second housing member for a vaneless impeller housing in accordance with the present invention.

Referring now to FIGS. 4 and 5, extending radially outwardly from wall 60 are a plurality of struts 140 including axially extending tabs 142. Wall 46 includes a plurality of inwardly extending and axially aligned slots 144. Slots 144 are arranged to engage tabs 142 for retaining member 32 to member 34 ensuring the described configuration of annular passage 66. As will be appreciated, tabs 142 and slots 144 are disposed across annular passage 66 creating a small but acceptable obstruction within annular passage 66. It will be appreciated, however, depending on the particular construction of the housing members obstructions may be totally avoided and/or one or more small obstructions that do not significantly contribute to noise may be disposed within annular passage 66.

Housing members 28, 30, 32, 34 and 36 include various other structures and features formed therein. These features may add to the strength of the member, facilitate alignment or assembly, provide for attaching the members and/or provide aesthetics. Several such features are shown in the drawings, but have not been individually referenced.

The foregoing description is for the purpose of teaching those skilled in the art the best mode of carrying out the invention and is to be construed as illustrative only. Numerous modifications and alternative embodiments of the invention will be apparent to those skilled in the art in view of this description. The details of the disclosed structure may be varied substantially without departing from the spirit of the invention, and the exclusive use of all modifications within the scope of the appended claims is reserved.

What is claimed is:

1. A vacuum cleaner comprising a driven impeller, wherein the impeller moves working air for the vacuum cleaner from an inlet passage through an impeller cavity into a discharge plenum and from the vacuum cleaner via a working air outlet; and a first housing member including a first wall and a second housing member including a second wall, the second wall being radially displaced from and substantially concentric with the first wall and the first wall and the second wall together defining an annular passage between the impeller cavity and the discharge plenum, the annular passage being formed integral with the impeller cavity, and radially outwardly of an outer peripheral edge of the impeller, and is substantially continuous and uninterrupted about the impeller cavity, wherein the impeller rotates and draws the working air through a working air inlet and directs the working air radially outwardly into the impeller cavity through the annular passage into the discharge plenum.

2. The vacuum cleaner of claim 1, wherein the annular passage comprises a minimum cross-section of a working air discharge path.

3. The vacuum cleaner of claim 1, wherein the annular passage is arranged substantially perpendicular to a radial discharge direction of the impeller.

4. The vacuum cleaner of claim 1, wherein the working air before and at the annular passage is substantially unobstructed.

5. The vacuum cleaner of claim 1, wherein the first housing member and the second housing member are separate components.

6. The vacuum cleaner of claim 5, further comprising a tab spanning the annular passage between the first wall and the second wall, the tab being secured to each of the first wall and the second wall for maintaining the relative relationship of the first wall with respect to the second wall.

7. The vacuum cleaner of claim 6, wherein the tab is formed on the first wall and an engaging end of the tab is received within a slot formed in the second wall.

8. The vacuum cleaner of claim 1, wherein the working air is substantially unobstructed before and at an inlet of the annular passage.

9. A housing for an air impeller, the air impeller arranged for moving working air from an inlet passage to an outlet passage of the housing, the housing including a first housing member including a first wall and the inlet passage and a second housing member secured to the first housing member and including a second wall and the outlet passage, the improvement comprising:

the first wall being radially displaced from and substantially concentric with the second wall thereby forming an annular passage in communication with the outlet passage and the annular passage is formed integral with an impeller cavity, and radially outwardly of an outer peripheral edge of the impeller, and is substantially continuous and uninterrupted about a full circumference of the air impeller.

10. The housing of claim 9, the annular passage being a minimum cross-section within a working air discharge path of the housing and wherein the working air discharge path before and at the minimum cross-section is substantially unobstructed.

11. The housing of claim 9, wherein the working air is unobstructed by vanes through the outlet passage.

12. The housing of claim 9, wherein the annular passage is unobstructed by vanes.

13. The housing of claim 9, further comprising a tab spanning the annular passage between the first wall and the second wall, the tab being secured to each of the first wall and the second wall for maintaining the relative relationship of the first wall with respect to the second wall.

14. The vacuum cleaner of claim 13, wherein the tab is formed on the first wall and an engaging end of the tab is received within a slot formed in the second wall.

15. A vacuum cleaner having a driven impeller, wherein the impeller moves working air for the vacuum cleaner, the impeller is disposed within a housing and the housing includes an inlet passage, an impeller cavity and a discharge plenum; the improvement comprising:

an annular passage being formed between the impeller cavity and the discharge plenum, the annular passage defined by a first wall member of the housing and a second wall member of the housing, the second wall member being radially displaced from the first wall member and substantially concentric with the first wall member, the annular passage extending substantially entirely about the impeller cavity and having a substantially constant width about a circumference thereof; and wherein the impeller rotates and draws the working air through the inlet passage and directs the working air radially outwardly into the impeller cavity, through the annular passage and into the discharge plenum, the annular passage restricting the flow of working air to provide back pressure.

16. The vacuum cleaner of claim 15, wherein the housing is disposed atop a debris cannister.

* * * * *